US009320309B2

(12) United States Patent
Morris

(10) Patent No.: US 9,320,309 B2
(45) Date of Patent: Apr. 26, 2016

(54) GLOVE-MOUNTED ELECTRONIC DEVICE RETENTION APPARATUS

(71) Applicant: Melinda Morris, Park City, UT (US)

(72) Inventor: Melinda Morris, Park City, UT (US)

( * ) Notice: Subject to any disclaimer, the term of this patent is extended or adjusted under 35 U.S.C. 154(b) by 0 days.

(21) Appl. No.: 14/108,431

(22) Filed: Dec. 17, 2013

(65) Prior Publication Data

US 2014/0165261 A1 Jun. 19, 2014

Related U.S. Application Data

(60) Provisional application No. 61/737,990, filed on Dec. 17, 2012.

(51) Int. Cl.
*A41D 19/00* (2006.01)
*A41D 27/20* (2006.01)

(52) U.S. Cl.
CPC ..... *A41D 19/002* (2013.01); *A41D 27/205* (2013.01)

(58) Field of Classification Search
CPC ..... A41D 19/002
USPC ..... 2/160, 247, 249–254, 69, 94, 108, 115, 2/159, 166, 161.1, 917
See application file for complete search history.

(56) References Cited

U.S. PATENT DOCUMENTS

| | | | | |
|---|---|---|---|---|
| 1,154,122 | A * | 9/1915 | Kovesy | 2/160 |
| 1,970,081 | A * | 8/1934 | Eisendrath | 126/204 |
| 4,670,909 | A | 6/1987 | Forrester | |
| 5,003,636 | A | 4/1991 | Marostica | |
| 5,623,731 | A * | 4/1997 | Ehrgott et al. | 2/160 |
| 5,694,261 | A | 12/1997 | Deal | |
| 6,826,782 | B2 * | 12/2004 | Jordan | 2/94 |
| 7,013,490 | B2 * | 3/2006 | Senter et al. | 2/160 |
| 7,837,112 | B2 * | 11/2010 | An | 235/462.44 |
| 7,992,225 | B2 * | 8/2011 | Demus | 2/247 |
| 8,418,264 | B2 * | 4/2013 | Alexander | 2/50 |
| 2005/0210562 | A1 | 9/2005 | Johnson | |
| 2007/0083979 | A1 | 4/2007 | Daniels | |

* cited by examiner

*Primary Examiner* — Tejash Patel
(74) *Attorney, Agent, or Firm* — Daniel Boudwin; Global Intellectual Property Agency, LLC

(57) ABSTRACT

A glove-mounted electronic device retention apparatus is provided. The present invention comprises a conventional glove having a pocket for storing an electronic device, such as a smartphone or an mp3 player, therein on either the palm side of the glove, the back side of the glove, or on both the palm and back side of the glove. The pocket may further have a transparent face for viewing and interacting with the electronic device. The present invention is designed so that individuals can easily listen to music on and otherwise use their electronic devices while participating in outdoor activities, without requiring the users to take their gloves off.

7 Claims, 5 Drawing Sheets

GLOVE-MOUNTED ELECTRONIC DEVICE RETENTION APPARATUS

CROSS REFERENCE TO RELATED APPLICATION

This application claims the benefit of U.S. Provisional Application No. 61/737,990 filed on Dec. 17, 2012. The above identified patent application is herein incorporated by reference in its entirety to provide continuity of disclosure.

BACKGROUND OF THE INVENTION

1. Field of the Invention

The present invention relates to article holders. More specifically, the present invention relates to article holders mounted on gloves for allowing individuals to use electronic devices without needing to remove their gloves.

Many individuals enjoy listening to music or may need to consult a phone to use its GPS or answer a phone call while participating in outdoor activities, such as hiking or skiing. However, holding a small electronic device while undertaking these activities can be tiresome or dangerous. Strenuous outdoor activities are only made more difficult and less enjoyable by being forced to hold a small electronic device throughout the activity. Tightly holding an electronic device for an extended period of time can cause the user's hand can become cramped, can throw off the user's balance, and can be distracting. Many outdoor activities require the individual's undivided attention or else the activity becomes dangerous; if the user is overly concerned about dropping the phone during the activity, then the user may be not be devoting his or her full attention to the activity at hand. If individuals keep their electronic device in their pocket, rather than their hand, while performing an outdoor activity, there are no issues associated with carrying the device, but the individual may be forced to remove his or her gloves to retrieve the electronic device, exposing his or her hand to the elements.

A variety of technologies currently exist to allow individuals to mount articles on their gloves for easy access and retrieval. Some devices comprise a pouch or pocket mounted on the back of the user's glove that is capable of storing a variety of items. However, these devices are not specifically designed to accommodate a music-playing electronic device and lack an aperture through which a headphone cord may be inserted. Other types of devices comprise a hand-mounted cellphone carrier, but such devices lack multiple potential carrying options for the electronic device and further do not comprise full gloves designed to protect the wearer's hands from cold temperatures. Therefore there is a need in the prior art for a glove-mounted article carrier that is specifically designed to removably hold electronic devices for listening to music and also adequately protects the users' hands from inclement weather.

The present glove-mounted electronic device retention apparatus provides a new and novel means for allowing users to listen to music from their electronic device, while simultaneously participating in outdoor activities. The present invention comprises a glove with multiple holding pouches that are specifically designed to hold electronic devices such as smartphones and mp3 players. The multiple pouches allow the user to change the orientation of the music-playing electronic device depending upon the specific activity the individual is participating in. The present invention further has a transparent face that allows the user to see the screen of his or her electronic device, thereby allowing the device to be easily utilized without any need to remove the device from the pouch at any point. The present invention is also specifically designed to be used in outdoor environments. Therefore, the present glove-mounted electronic device retention apparatus addresses all of the issues present in the prior art.

2. Description of the Prior Art

Devices have been disclosed in the prior art that relate to gloves with utility attachments. These include devices that have been patented and published in patent application publications. These devices generally relate to gloves having pockets or other attachments for holding devices. The following is a list of devices deemed most relevant to the present disclosure, which are herein described for the purposes of highlighting and differentiating the unique aspects of the present invention, and further highlighting the drawbacks existing in the prior art.

One such device is U.S. Pat. No. 4,670,909 to Forrester, which discloses a glove having a zippered pocket. The storage compartment is integral to the device, with the outer side of the pocket forming the outermost side of the glove. The storage compartment may be used to store a wide variety of items. Unlike Forrester, the present invention is designed solely to hold electronic devices such as smartphones and mp3 music players and the present invention additionally has a transparent front cover for seeing the screen of the electronic device while it is in the pocket.

Another such device is U.S. Pat. No. 5,003,637 to Lonon, which discloses a glove with a utility attachment for holding a wide array of items. The utility attachment is removably affixed to the outer portion of the glove using hook-and-loop fastener material. The pockets of the present invention are integrally connected with the glove and are not designed to be removable. Furthermore, the present invention is specifically designed to hold only a specific category of devices, i.e. electronics devices such as smartphones and mp3 players, whereas Lonon is designed to hold a wide range of devices.

Yet another such device is Published U.S. Patent Application Publication No. 2005/0210562 to Johnson, which discloses a retainer portion attached to the backside of a glove. The retainer is designed to hold game calls, which are used by hunters to attract game. This allows the user to utilize a game call without having to take his or her gloves off to retrieve the game call, which can be a very inconvenient process, especially in the winter. Like the present invention, Johnson is intended primarily for outdoor use. Both Johnson and the present invention allow users to utilize particular articles without having to remove their gloves, but the present invention is designed to hold electronics devices, not game calls.

Finally, Published U.S. Patent Application Publication No. 2007/0083979 to Daniels discloses a glove-like garment that fits over the user's hand and has a means for retaining a cell phone on the back area of the user's hand. The garment is preferably fingerless or has only short finger sections. The present invention comprises a full glove that covers the user's entire hand, including the fingers, as it is intended to be used outside during winter. The present invention also has means for holding a smartphone, or an mp3 music player, on either the palm or back sides of the glove. The Daniels device comprises only a single means for holding a phone on one side of the glove.

The present invention provides a new and novel glove having attached means for easily and comfortably retaining a smartphone or mp3 music player. There is alternately a pocket for holding the electronics device on either the palm or back sections of the glove, depending on the embodiment, allowing users to adjust the location of the electronic device depending upon the task the individual is currently undertaking. The present invention may further include a transparent face section for viewing the screen of the device that the user is currently utilizing. The device is designed to allow users to easily listen to music on their electronic devices and therefore includes a hole in the electronic device retaining pocket to allow earbuds to be plugged therethrough and a guide clip for securing the wire portion of the earbuds. It substantially diverges in design elements from the prior art and consequently it is clear that there is a need in the art for an improvement to existing glove-based article retention devices. In this regard the instant invention substantially fulfills these needs.

SUMMARY OF THE INVENTION

In view of the foregoing disadvantages inherent in the known types of glove-supported article retention apparatuses now present in the prior art, the present invention provides a new glove-supported electronic device support apparatus wherein the same can be utilized for providing convenience for the user when listening to music or otherwise utilizing one's electronic device without removing one's gloves.

It is therefore an object of the present invention to provide a new and improved glove-mounted electronic device retention apparatus that has all of the advantages of the prior art and none of the disadvantages.

It is another object of the present invention to provide a glove-supported electronic device retention apparatus that allows users to use their electronic device without removing their gloves.

Another object of the present invention is to provide a glove-supported electronic device retention apparatus that offers users multiple options for positioning their electronic device on their hands.

Yet another object of the present invention is to provide a glove-supported electronic device retention apparatus that allows users to see and interact with their electronic device's screen.

Yet another object of the present invention is to provide a glove-supported electronic device retention apparatus that securely retains the user's electronic device throughout the user's participation in outdoor activities.

Yet another object of the present invention is to provide a glove-supported electronic device retention apparatus that allows users to comfortably use their phone while participating in outdoor activities.

A still further object of the present invention is to provide a glove-supported electronic device retention apparatus that allows access to, and conveniently supports, the users' earbuds.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
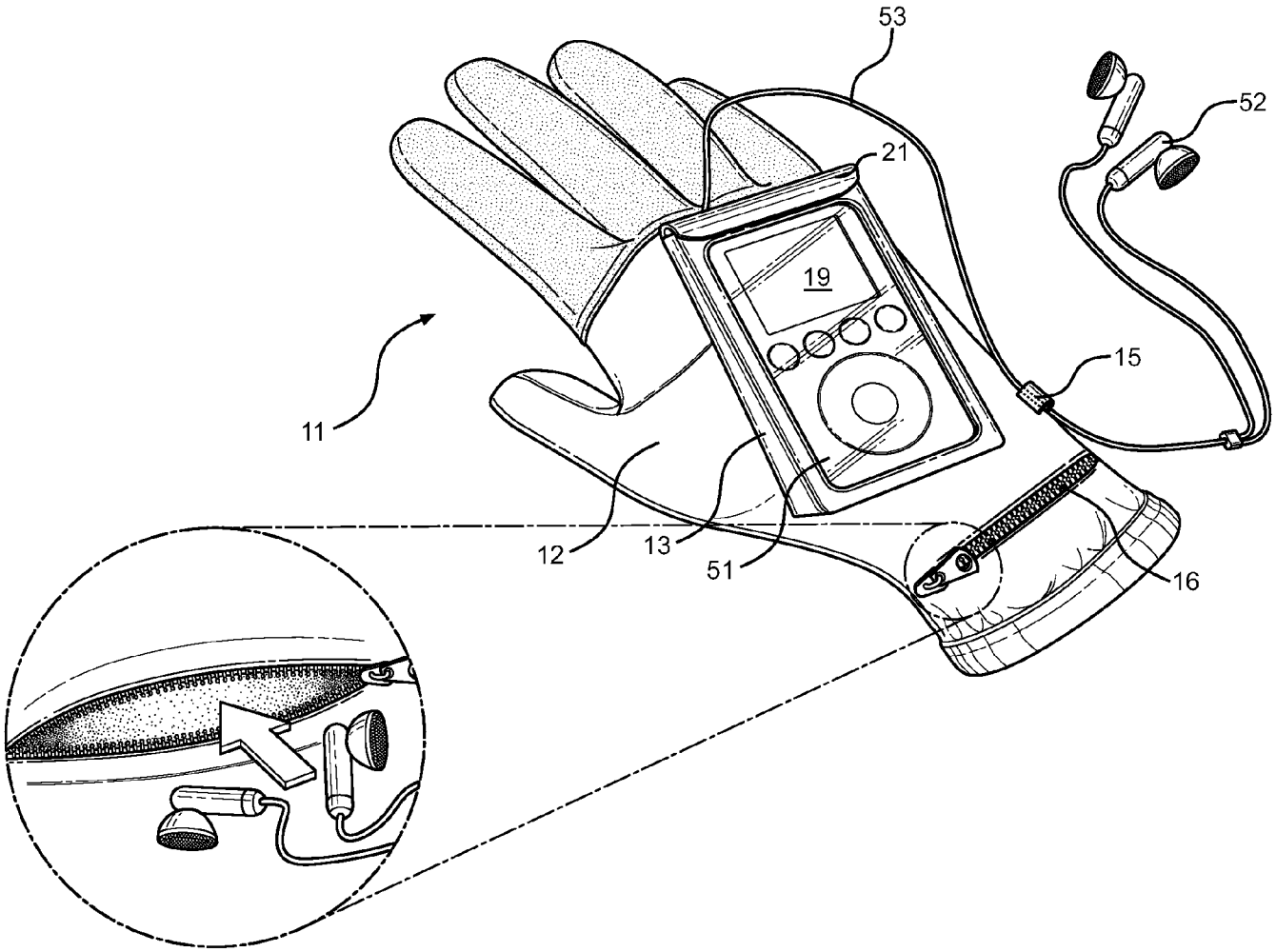
FIG. 1 shows a perspective view of the back portion of the present invention.

Reference is made herein to the attached drawings. Like reference numerals are used throughout the drawings to depict like or similar elements of the glove-supported electronic device retention apparatus. For the purposes of presenting a brief and clear description of the present invention, the preferred embodiment will be discussed as used for listening to music or otherwise utilizing one's smartphone or mp3 player while participating in outdoor activities. The figures are intended for representative purposes only and should not be considered to be limiting in any respect.

Figure 2:
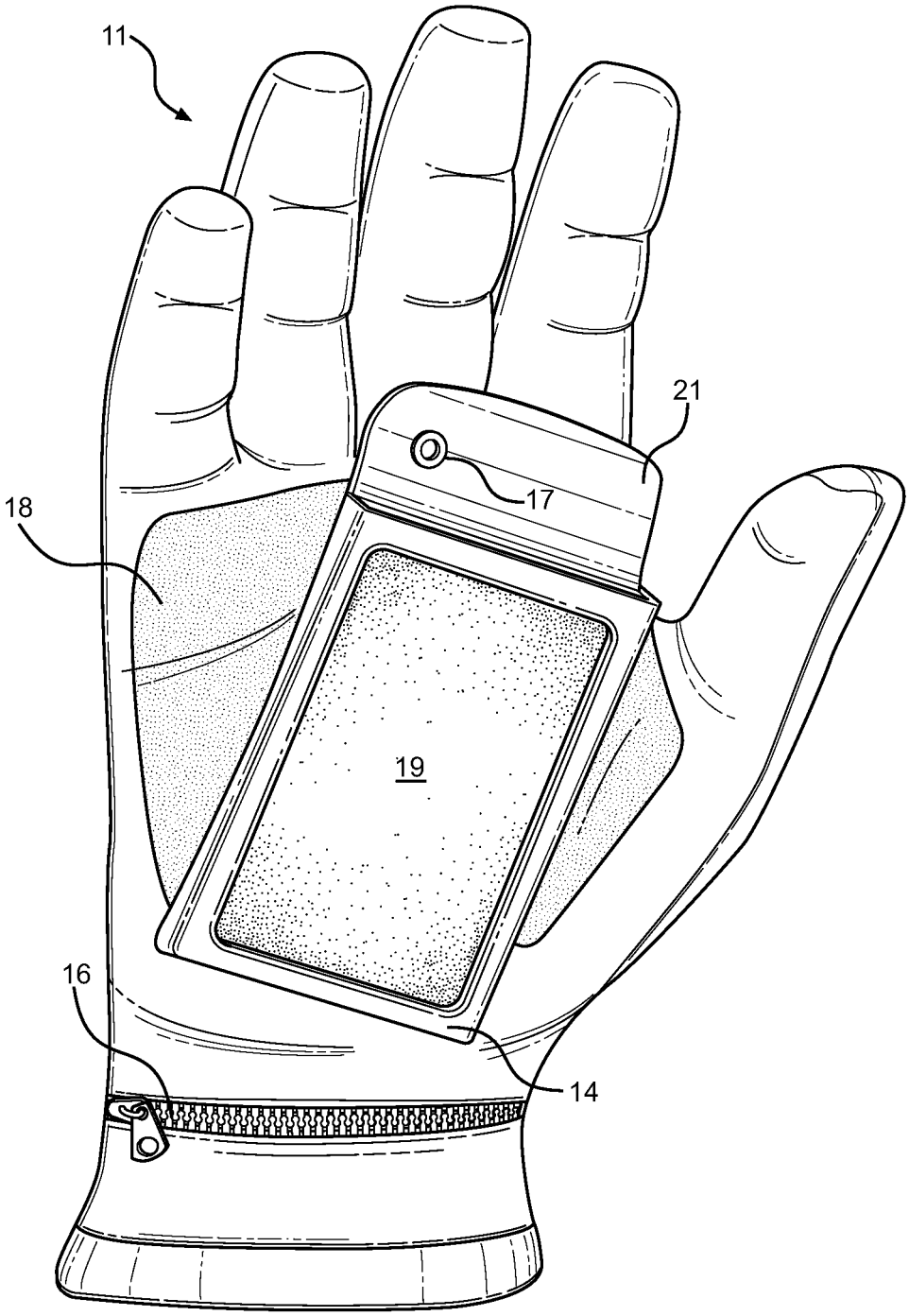
FIG. 2 shows a perspective view of the palm portion of the present invention.

Referring now to FIGS. 1 and 2, there are shown perspective views of the back and the palm portions of the preferred embodiment of the present invention. The present invention comprises a glove 11 having a back portion 12 and a palm portion 18, a first retention means 13 disposed on said back portion 12, and a second retention means 14 disposed on said palm portion 18. The present invention may have either both a first and second retention means 13, 14 or have either a first or second retention means 13, 14. The glove 11 of the present invention is otherwise a conventional glove as is known in the prior art, having a plurality of finger portions and a tapered portion around the wrist. No claim is made as to the material that the glove 11 portion is composed of, but it is preferably composed of water-resistant, insulting material that is suitable for user in winter weather. The glove 11 may be provided in lightweight embodiments, embodiments designed for use during the winter, or embodiments designed for use during sports activities.

The first and second retention means 13, 14 comprise pockets that are attached to the back portion 12 and the palm portion 18, respectively, of the glove 11. The first retention means 13 and the second retention means 14 are substantially identical. The pockets are adapted to hold an electronic device 51 therein and comprise a plurality of side walls, a base wall, and a flap 21. The electronic device 51 that the first and second retention means 13, 14 are adapted to hold may include any type of smartphone, mp3 player, or other mobile electronic device. As different electronic devices 51 have different shapes and configurations, no claim is made as to the exact size or shape of the retention means 13, 14. The retention means 13, 14 may be composed of the same material as the glove 11, or may be composed of a different material. The retention means 13, 14 are preferably composed of weather-resistant material, protecting the electronic device 51 stored therein from the elements.

The outer-facing sidewall of the retention means 13, 14 may comprise a transparent surface 19, allowing the display screen of the electronic device 51 to be viewed and manipulated by the user. The transparent surface 19 is preferably composed of transparent, flexible plastic that allows the buttons or touchscreen of the electronic device 51 to be utilized. The transparent surface 19 is permanently and integrally attached to the sidewalls of the pockets, creating a waterproof seal that prevents liquid from entering the retention means 13, 14 and damaging the electronic device 51 stored therein. No claims is made as to the precise shape or configuration of the transparent surface 19, although preferably it provides the user with access to the full display screen of the mobile electronic device 51. Alternatively, the transparent surface 19 may be removable.

The flap 21 covers the open top portion of the retention means 13, 14 and protects the electronic device 51 stored therein from water damage, while at the same time allowing the electronic device 51 to be freely removed. The flap 21 is permanently secured to the retention means 13, 14 at one end and is removably attached to the retention means 13, 14 at the opposite end. The flap 21 may be attached via any manner of temporary attachment, including hook-and-loop fastener material or a clasp. The flap 21 has an aperture 17 disposed through it for allowing the cord 53 from a pair of earbuds 52 to pass therethrough, allowing the user to listen to music on his or her electronic device 51, while at the same time having it protected within the retention means 13, 14. The aperture 17 is adapted to align with the conventional location of an electronic device's 51 headphone input, which is generally on the left side of the device. The aperture 17 allows the cord 53 from a pair of earbuds 52 to be inserted therethrough without having to open the flap 21, exposing the electronic device 51 stored within the retention means 13, 14 to the elements.

The present invention preferably has a zippered pouch 16 disposed along the back portion 21 or the palm portion 18. The zippered pouch 16 is adapted to hold small articles, such as a pair of earbuds 52, money, or keys, when not being utilized by the user. The present invention preferably further has a guide clip 15 disposed on the glove 11 that is adapted to removably to hold a cord 53 in place so that it does not become tangled or otherwise interfere with the user's ability to participate in activities while using the present invention. In the depicted embodiment, the guide clip 15 comprises a detachable loop of material.

Figure 3:
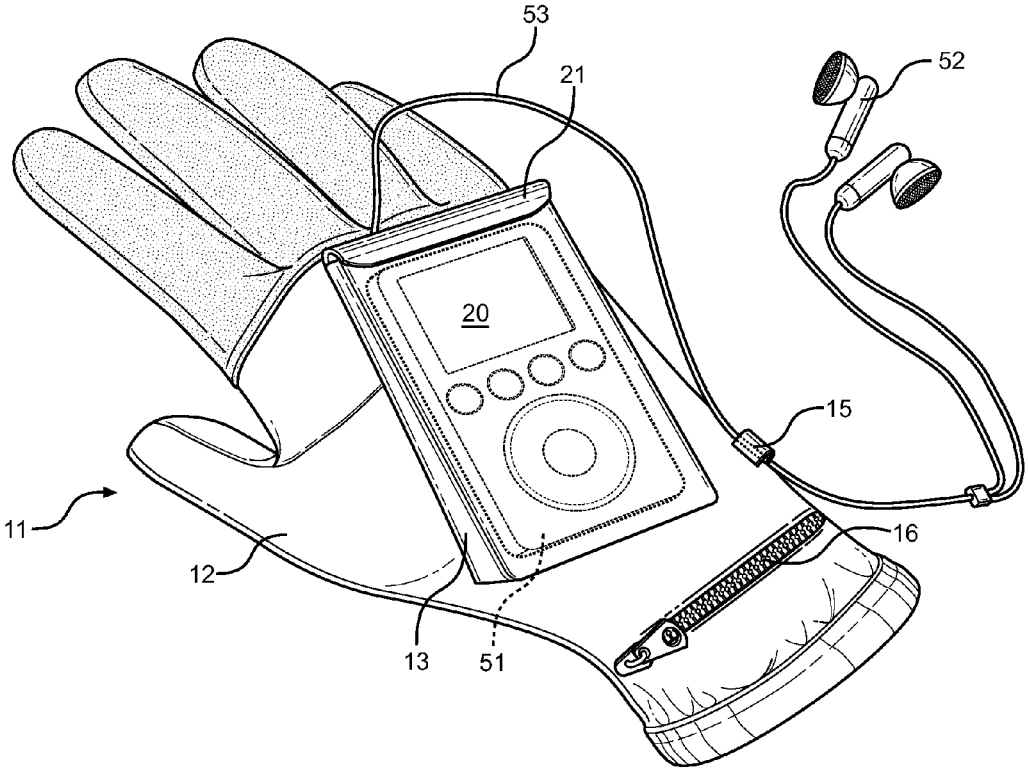
FIG. 3 shows a perspective view of the back portion of an alternate embodiment of the present invention.

Referring now to FIG. 3, there is shown a perspective view of the back portion of an alternate embodiment of the present invention. In the preferred embodiment, the retention means 13, 14 have a transparent surface, as described above. However, the retention means 13, 14 may instead have a non-transparent surface 20. In this alternate embodiment, the sidewalls of the retention means 13, 14 are contiguous and do not have the transparent plastic portion disposed thereon.

Figure 4:
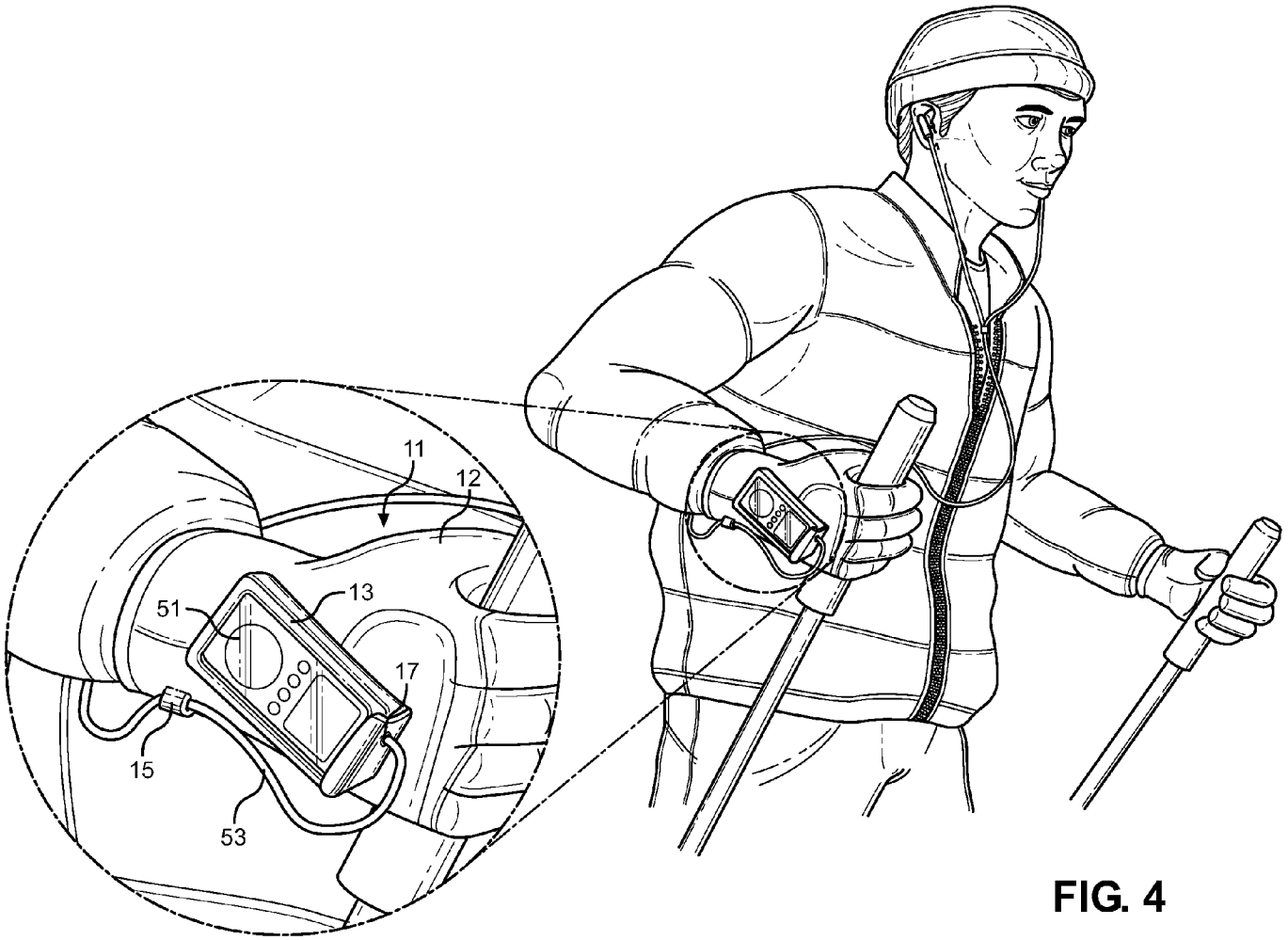
FIG. 4 shows a perspective view of the present invention in use.
Figure 5:
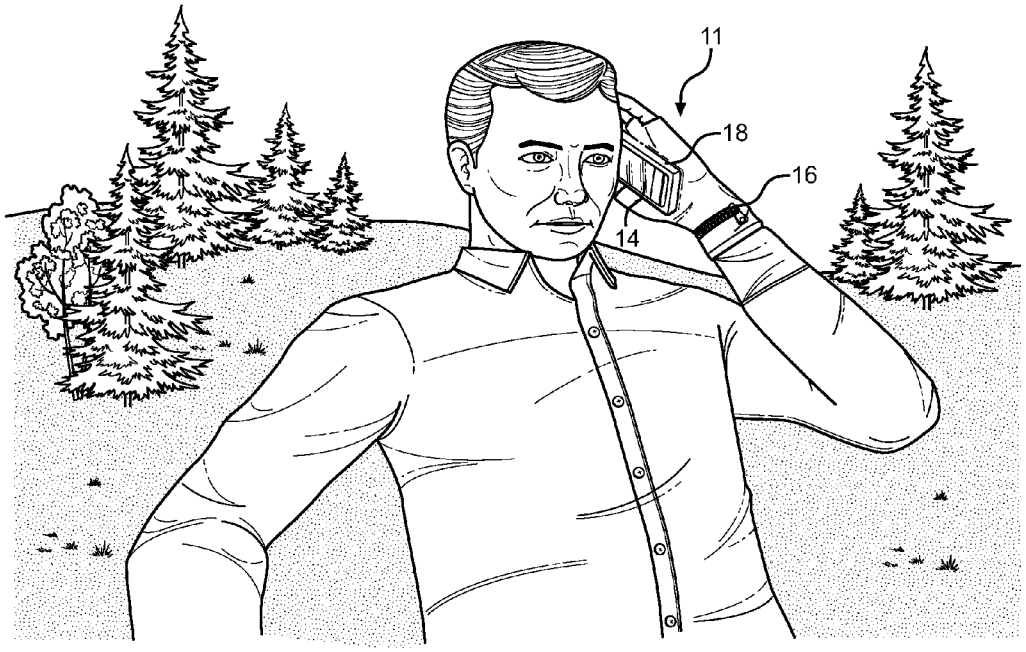
FIG. 5 shows a perspective view of the present invention in use.

Referring now to FIGS. 4 and 5, there are shown perspective views of the present invention in use. The present invention is adapted for outdoor use so that the user has access to his or her electronic device 51 at all times, without needing to carry the electronic device 51 or take his or her gloves off to interact with and use the electronic device 51. The present invention may be provided in embodiments having both a first and a second retention means 13, 14 or embodiments having a single retention means disposed on either the palm or back surface of the glove 11. Embodiments having an electronic device retention means 13 disposed on the back surface allow the user to listen to music or otherwise use the electronic device while taking part in activities that require use of the user's hands. Embodiments having an electronic device retention means 14 disposed on the palm surface allow the user to easily make calls without the user having to remove his or her gloves, which can be highly advantageous in cold or inclement weather. Embodiments of the present invention having both retention means 13, 14 allow the user to position his or her electronic device 51 in either of the pockets.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A glove-mounted electronic device retention apparatus, comprising:

a glove having a palm portion and a back portion;

a first electronic device retention means disposed on said back portion, said first electronic means having an aperture adapted to permit earbuds to be inserted therethrough to engage with an electronic device;

a second electronic device retention means disposed on said palm portion, said second retention means having an aperture adapted to permit earbuds to be inserted therethrough to engage with said electronic device.

2. The glove-mounted electronic device retention apparatus of claim 1, further comprising a zippered pouch disposed on said glove.

3. The glove-mounted electronic device retention apparatus of claim 1, further comprising a guide clip disposed on said glove, said guide clip adapted to removably retain an earbuds' cord.

4. The glove-mounted electronic device retention apparatus of claim 1, wherein said first electronic device retention means and said second electronic device retention means have a transparent surface.

5. The glove-mounted electronic device retention apparatus of claim 4, wherein said transparent surface is removable.

6. The glove-mounted electronic device retention apparatus of claim 1, wherein said first electronic device retention means comprises a pocket having a flap thereon adapted to removably enclose said electronic device within said pocket.

7. The glove-mounted electronic device retention apparatus of claim 6, wherein said aperture adapted to permit earbuds to be inserted therethrough is positioned on said flap.

* * * * *